United States Patent [19]

März

[11] 4,314,686

[45] Feb. 9, 1982

[54] FOLD-FLAT

[76] Inventor: Helmut März, Haydnweg 3, 7141 Beilstein, Fed. Rep. of Germany

[21] Appl. No.: 70,046

[22] Filed: Aug. 27, 1979

[30] Foreign Application Priority Data

Aug. 28, 1978 [DE] Fed. Rep. of Germany ..... 2837430

[51] Int. Cl.[3] ..... B65D 19/12

[52] U.S. Cl. ..... 248/346; 108/55.1; 108/56.1; 206/600; 220/6

[58] Field of Search ..... 108/56.1, 53.1, 53.3, 108/55.1, 55.3; 248/346; 206/386, 599, 600; 220/1.5, 6

[56] References Cited

U.S. PATENT DOCUMENTS

| | | | |
|---|---|---|---|
| 3,752,332 | 8/1973 | Theurer | 206/600 |
| 4,131,071 | 12/1978 | Glassmeyer | 108/53.1 |
| 4,240,359 | 12/1980 | Howe | 108/56.1 X |

*Primary Examiner*—William E. Lyddane

*Attorney, Agent, or Firm*—Michael J. Striker

[57] ABSTRACT

A fold-flat transporting device including a floor base and two end walls which may be folded or arranged in upright position. The device is provided with a locking arrangement which locks the end walls in the upright position. The locking arrangement includes a wedge pivotable on a two-armed lever which is also pivotable about a pivot mounted on the base and extending through the lever. In the closed position the pivotable wedge enters a slot provided in the end wall and becomes arrested within said slot.

11 Claims, 4 Drawing Figures

FOLD-FLAT

BACKGROUND OF THE INVENTION

The invention relates to a fold-flat consisting of a floor plate and two end walls which, on being transported in empty state may be folded inward onto the loading area of the floor plate, whilst, when transporting goods they can be locked in upright position by means of a locking device.

The designation fold-flat denotes container-like transportation equipment consisting of a floor and two end walls, provision being made with these flats that for the purpose of space saving when transported in empty state, both end walls may be folded down inward onto the loading area of the floor.

When the flat is being loaded, the two end walls are pivoted into a upright position and fixed in that position. During transportation, large forces may act in the longitudinal direction of the flat, especially onto the end walls, in the direction of folding down, and they must be accommodated by appropriate locking.

For this purpose, it has already been proposed to brace the end walls in the longitudinal direction by struts, or to use special inserting pins in addition to the hinge pins around which the end walls may be folded.

Finally, in order to brace the end walls in their upright position locking devices, have been proposed using threaded connections.

This last-named locking device, allowing bracing of the end walls standing upright relative to the floor, is very expensive in its design and prone to require maintenance. On unfolding the end walls, the threads must be manually tensioned and the threaded nuts must be additionally secured. Due to the continually alternating loads acting upon the end walls during transportation, the tensioning of the thread may loosen and locking of the end walls may not be ensured any longer. Finally, locking by thread is sensitive against damages, sensitive against dirt and rust, and can be repaired only with difficulties.

SUMMARY OF THE INVENTION

The invention is therefore based upon the task of creating a locking device for flat-folds avoiding the afore-named disadvantages, being of simple design, and allowing simple, fast, and safe operation.

As per invention, this is achieved by the locking device consisting of at least one wedge which on upright position of the end wall can be so introduced into a slot of the end wall that end wall and bottom plate can be braced relative to each other.

Preferably, the wedge is arranged pivotable on the first arm of a two-armed lever, which itself is supported, pivotable, on an essentially horizontal axle attached to the bottom plate, the second arm of the lever forming an operating handle for that lever.

Suitably, the wedge can furthermore be pivoted at the end of the first arm of the two-armed lever around an essentially horizontal axle, whereby its pivoting movement around this axle is limited by a stop.

Advantageously, the operating handle of the lever can be acted upon by a compression spring in the closing direction of the wedge.

Herein, the compression spring is appropriately arranged between the operating handle and the bottom plate in such a manner that on opening of the wedge, it can be pivoted beyond the line connecting the pivot of the two-armed lever and its own point of attachment to the floor plate, whereby the two-armed lever can be locked in the opened position of the wedge.

Preferably, the weight of the wedge is finally selected sufficiently large, so that in case of a possible failure of the spring, the wedge will pivot in the direction of closing under its own weight or, respectively, remain in closed position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
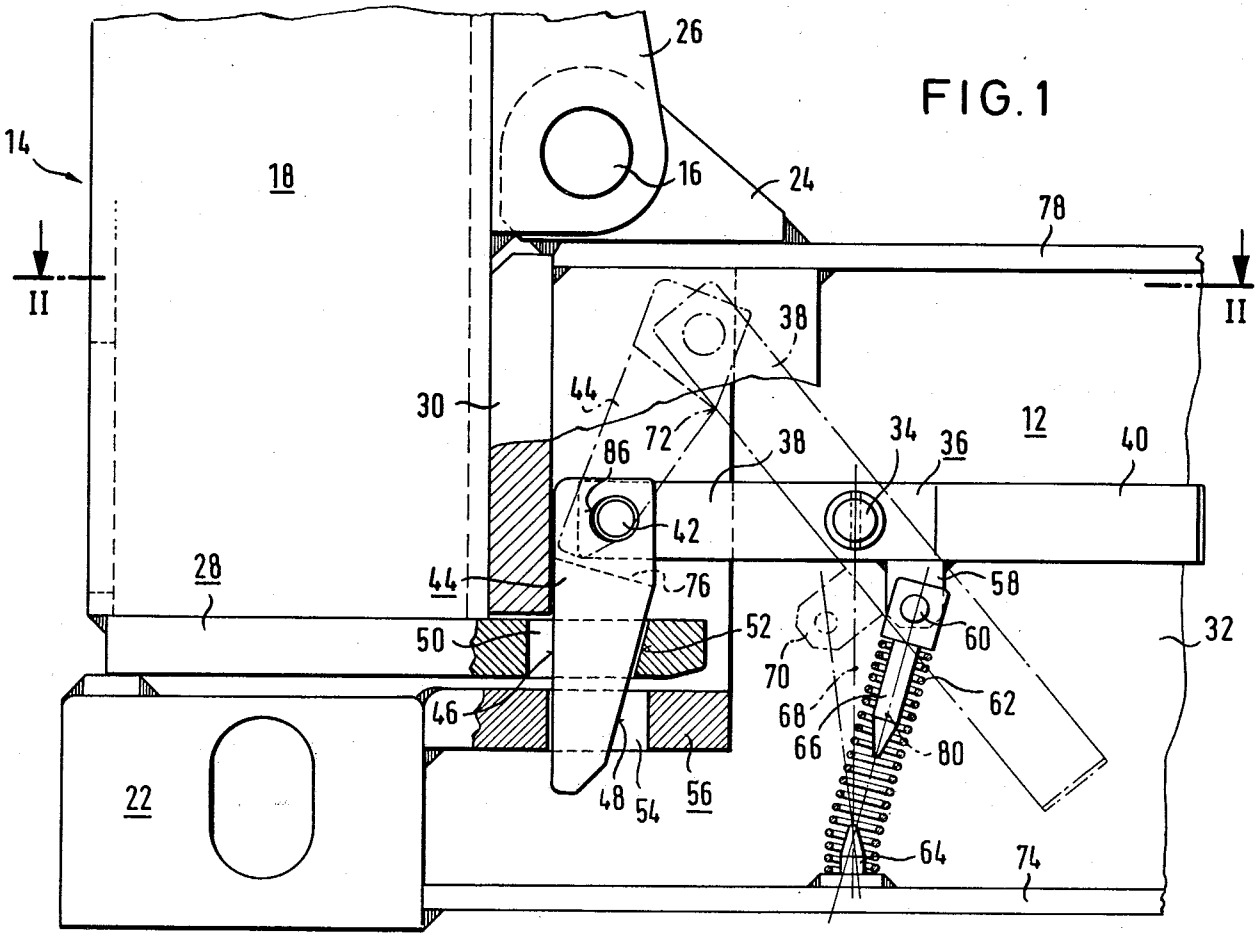
FIG. 1 is a side view of a locking device in partial section.
Figure 3:
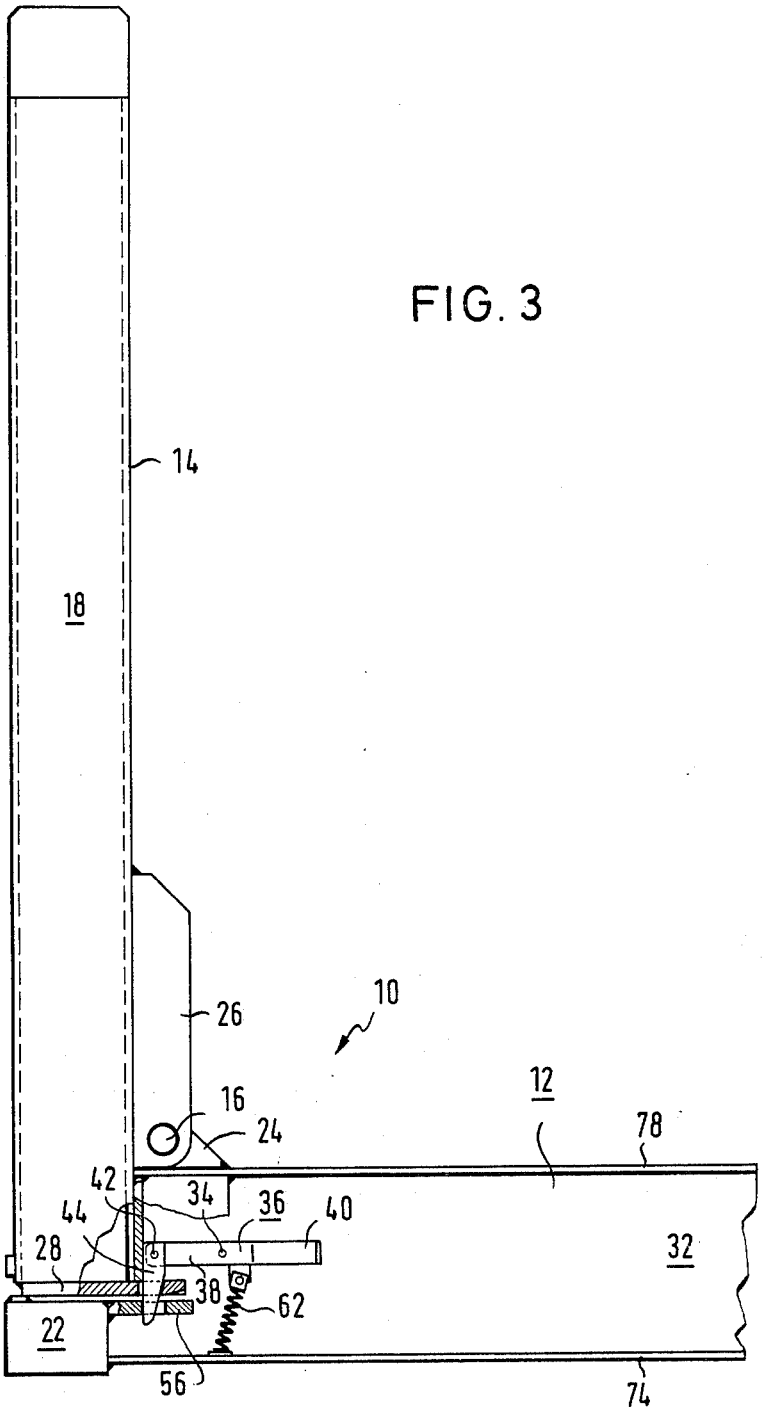
FIG. 3 is a schematic side view of an end wall and a part of a floor plate of a fold-flat.

As shown in FIG. 3, a fold-flat 10 consists in essence of a floor plate 12 and two end walls 14, of which only one is shown in FIG. 1. The floor plate 12 may consist of a suitable frame, for instance made of rails of I shape, and of an appropriate decking.

The end walls 14, which, f.i., can be constructed from two corner posts 18 each and one connecting wall 20 (FIG. 2), are linked via the link pin 16 with the floor plate 12, as particularly shown in FIG. 1, so that they can be folded down to a horizontal position on the loading area of the floor plate 12 to allow space-saving transportation when empty. During the transportation of goods, however, the end walls 14 will assume a vertical position, as particularly shown in FIG. 3, and in this position they are locked and braced relative to the floor plate 12.

In the position shown in FIG. 1, the end wall 14 of which the corner post can be seen, is in vertical position, in which it rests on a foot 22 which is welded to the floor plate 12.

In the embodiment as shown, each of the four corner posts of the flat is provided at its lower end with a bottom plate 28 welded onto the respective corner post 18 and, as shown in FIG. 1, resting on the foot 22. The joint between the end wall 14 and its corner post 18 respectively, and the floor plate 12, is made, as already noted, via the link pin 16 and also the straps 26 and 24 which are correspondingly welded onto the corner post 18 or the the floor plate 12 respectively, and which have appropriate holes through which the link pin 16 may extend, the latter being secured in a suitable manner against axial displacements.

In the vertical position, the corner post 18 will, as shown in FIG. 1, abut with its lower end against the essentially vertical head plate 30 which is welded to the floor plate 12.

In the embodiment shown, the floor plate consists of a frame with an I shape opened towards the outside, i.e. a vertical web 32 connecting a lower horizontal leg 74 and an upper horizontal leg 78. It may also consist of an U-shape opened towards the outside.

As shown particularly in FIG. 3, a locking device is arranged within this shape, allowing to lock and brace the end wall 14 or its corner posts 18 respectively, in vertical position relative to the floor plate 12, with a locking device allotted to every corner post 18, i.e., a total of four locking devices for the four corner posts 18 of the two end walls 14 of a flat 10.

Figure 2:
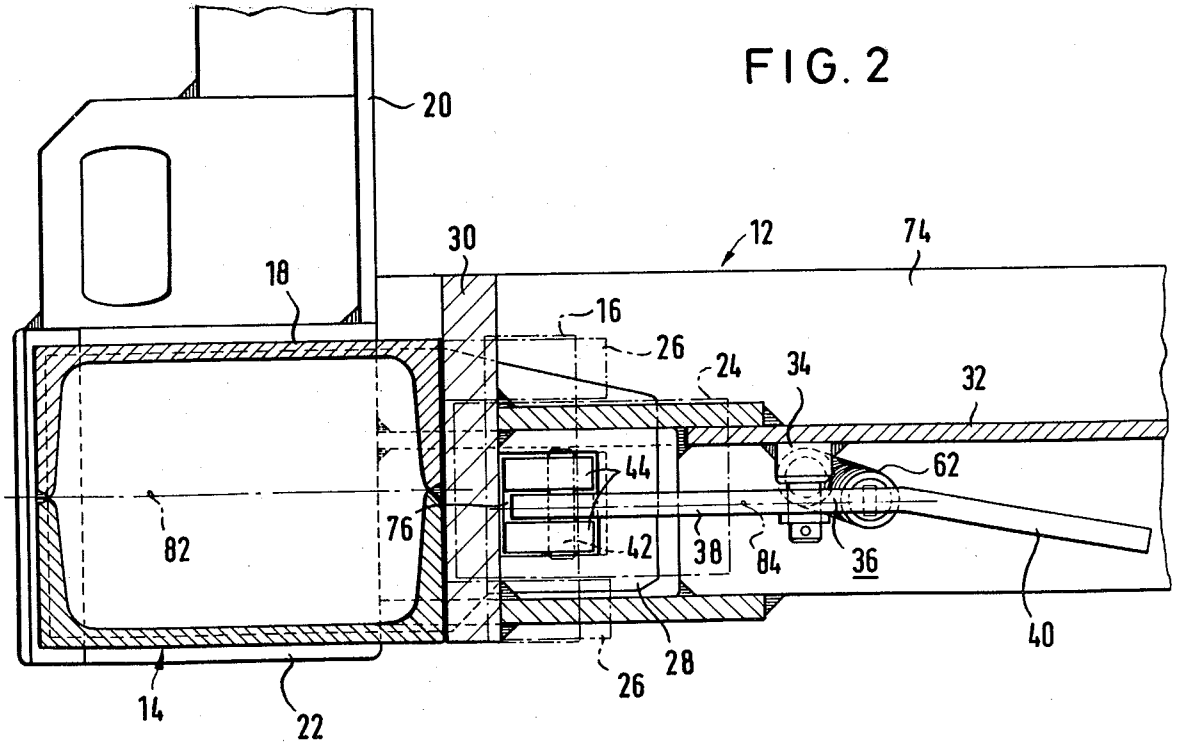
FIG. 2 illustrates the locking device as per FIG. 1 in a section along the line II—II of FIG. 1.

The locking device consists of a wedge 44 pivotable around a pin 42 arranged at the end of a first arm 38 of a two-armed lever 36. The two-armed lever 36 can be pivoted in its center zone around a pin 34 which, as shown in FIG. 2, is attached or welded respectively to the web 32 of the I shape forming the floor plate 12. In the embodiment as shown, the pin 34 as well as the pin 42 are running practically horizontal, so that the two-armed lever 36, and thus the wedge 44, can be pivoted in a vertical plane. (The designations horizontal and vertical refer to the normal using or operating position of the floor plate 12).

A second arm 40 of the two-armed lever 36 extends opposite to the first arm 38, forming an operating handle for the actuation of the lever 36 or, respectively, the wedge 44.

The bottom plate 28 welded onto the corner post 18, has a slot 50 provided with an incline 52 on the side opposite to the corner post 18. The wedge 44 has a rear face 46 which can impact against the side of the head plate 30 facing toward the floor plate 12, and, furthermore, the bottom plate 28 has a slot 54 at a side facing the head plate 30, the slot being formed within an anchor plate 56 which on its part is welded to the foot 22. The slots 50 within the bottom plate 28 and 54 in the anchor plate 56, are partially aligned in the vertical position of the corner post 18 as shown in FIG. 1. The wedge 44 extends through the two slots 50 and 54, wherein its back 46 can rest against the head plate 30 and the anchor plate 56, whilst its taper 48 is in engagement with the incline 52 of the slot 50 of the bottom plate 28. The angle of the taper 48 and the incline 52 is selected in such a manner that the connection between the wedge 44 and the bottom plate 28 locking will always be self-locking.

As shown in FIG. 1, the corner post 18 and with it the end wall 14, are thus locked against the floor plate 12 since the wedge 44 extends through both slots 50 and 54. Furthermore, the wedge is continually acted upon in the direction of closing by a compression spring 62 extending between the leg 74 of the floor plate 12 and the arm 40 of the two armed lever 36. For this purpose, a projection 58 is attached, f.i. by welding to the arm 40 on that side of the axle of the pin 34 opposite to the wedge 44, with the head of a guide pin 66 being connected to the projection 58 by a pin 60 held therein, with the compression spring 62 being inserted with one end over the pin. A second guide pin 64 is attached to the leg 74 of the floor plate 12, f.i. by welding, in such a manner that its central axis is located about below the central axis of the pin 34.

In the closed position of the wedge, shown in FIG. 1, wherein the corner post 18 is locked and braced, the center line 80 of the compression spring 62 is, in the drawing, inclined at an angle to the connecting line 68 between the guide pin 64 and the center axis of the pin 34. The spring 62 will continually endeavor to pivot the two-armed lever 36, and thus the wedge 44, in a counter-clockwise direction, so that the wedge 44 is pressed into the slot 50 of the floor plate 28 as far as geometrically possible.

If, therefore, shocks should occur during transportation, and the corner post 18 should, for instance, be pressed with its lower end horizontally in the direction of the floor plate 12 or moved somehow in this direction, so that a small gap forms between the taper 48 and the incline 52, the wedge 44 will, due to the action of the compression spring 62 and/or due to its own weight, follow until it again rests snugly against the incline 52. Since the connection between wedge and floor plate is self-locking, the wedge cannot be pivoted out of the slot 50 in the opposite direction, i.e. clockwise, by a force moving in the opposite direction, i.e. the corner post 18 is not only locked relative to the floor plate 12, but it is also continually braced against it since every shock acting on the end walls and the corner post 18 will cause, as already mentioned, automatic following of the wedge 44 if a gap between the taper 48 and the incline 52 has formed.

If the end wall is to be folded towards the loading area of the floor plate 12, in order to reduce the space required, since several empty flats can be transported stacked above each other, the wedge 44 is pivoted out of the two slots 50 and 54 which can be made, for instance, by grasping by hand the arm 40 and turning it clockwise into the position shown by the dash-dot line. (It is herein not absolutely necessary to grasp the handle by hand, it is also possible to step with the foot onto this handle 40, whereby the lever 36 is also turned clockwise and the locking is released).

The arm or operating handle 40 may, as shown in FIG. 2, be designed with a certain offset so that it can better be worked by hand or foot.

The lever 36 is pivoted clockwise until the center line, or line of action 80, respectively, of the spring 62 passes the connecting line 68 in the clockwise direction and until it reaches the position 70 in which it is inclined at an angle to the left relative to the connecting line 68. In this position, the wedge 44 is fully pulled out of the slots 50 and 54, so that the corner post 18 and thus also the corresponding end wall can be pivoted by 90° down and inwards, so that it will rest upon the loading surface of the floor plate 12.

FIG. 1 shows that in the position of the two-armed lever 36 as shown in the dot-dash line, the line of action 80 of the spring, i.e. in position 70, is now running to the left of the pivoting axis of the pin 34, whereby the lever, and thus the wedge 44, are locked in the open position. The lower surface of the upper leg 78 of the floor plate 12 may serve here as a counter stop, or provision may be made for another suitable stop.

As shown in FIG. 2, the wedge 44 has a slot 76 into which the end of the arm 38 can extend, and the lower base area of the slot 76, or the edge 72 respectively between the base area of the slot and the side wall of the wedge will form a stop for the wedge 44, since this edge 72, as shown in FIG. 1, will abut the arm 38 when the wedge is in the open position, so that the pivoting movement of the wedge 44 around the pin 42 is limited in the counterclockwise direction. By this, it is accomplished that the wedge can be introduced into the slots 50 and 54 without any hindrance, provided the corner post 18 has been unfolded again into its upright position as shown in FIG. 1.

If the corner post 18 has again assumed this position, the lever 36 must be grasped at the operating handle 40 and pivoted counterclockwise, which will require a certain force since during this pivoting movement the spring 62 is somewhat compressed. As soon as the line of action 80 of the spring has passed the connecting line 68, the spring will support the pivoting movement of the lever 36 and will attempt to press the wedge 44 into the slots 50 and 54, whereby the corner post 18 is again locked and braced against the floor plate 12.

As shown in FIG. 2, the center line 84 of the lever 36 will essentially coincide with the center line 82 of the corner post 18, so that torsional forces are avoided.

The slot 54 in the anchor plate 56 is not absolutely required. It will be sufficient when the wedge 44 can rest with its rear face against the head plate 30 as well as against the face 82 of the anchor plate 56. For this, it will, however, not be required that a slot 54 is incorporated into the anchor plate 56.

Figure 4:
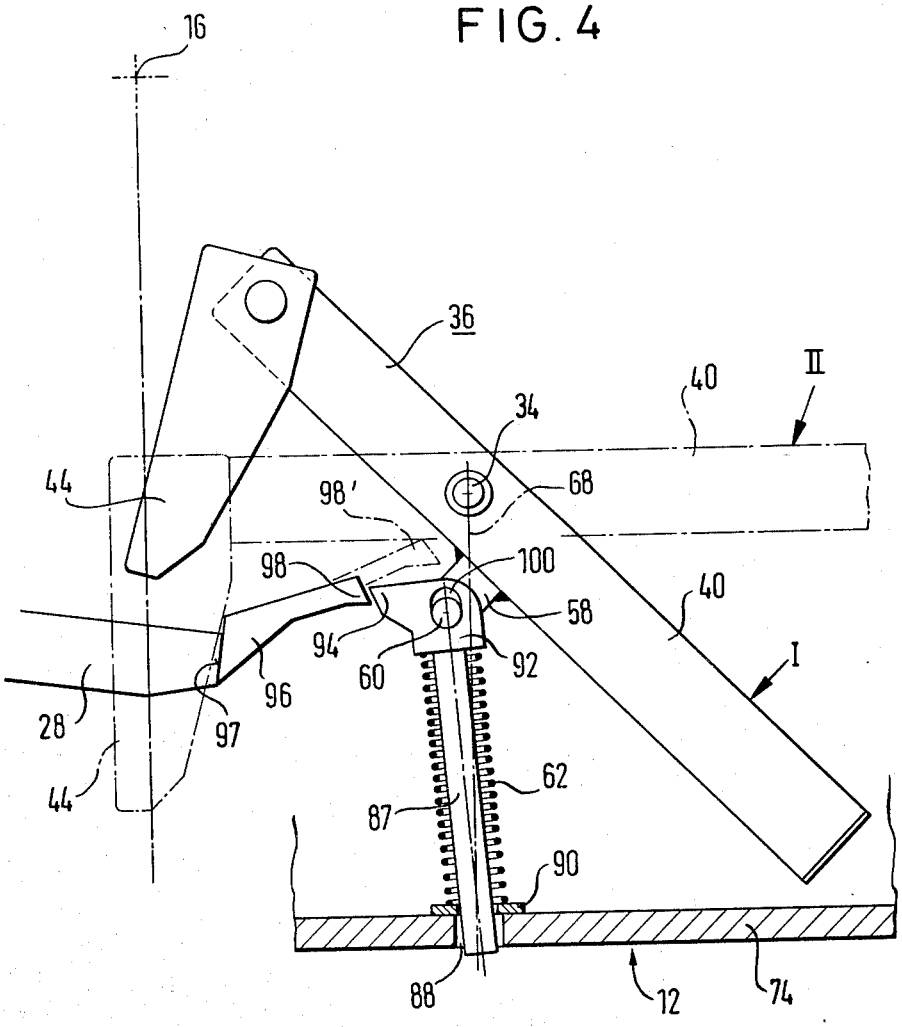
FIG. 4 shows a further embodiment of the locking device as per FIG. 1, provided with a device for the positive closing of the locking device.

The bore of the wedge 44 which is so attached to the pin 42 that it can pivot, is designed in the shape of a slot 86 in order to give it sufficient play, so that, under the influence of the force exerted upon it by the corner post 18, it may rest against the head plate 30 and the anchor plate 56. By this, it will be avoided that the force exerted by the corner post 18 onto the wedge 44 must be accommodated by the two-armed lever and its trunnion 34. The embodiment as per FIG. 4 has been further developed versus the one as per FIG. 1.

Instead of the guide pin 66 as per FIG. 1, a guide bolt 87 (FIG. 4) has been provided here with its head 92 being in pivoting connection with the strap, or nose respectively, 58, via a pin 60. Deviating from the embodiment as per FIG. 1, this head 92 is, however, provided with a nose 94 which, as will yet be described, acts in conjunction with a stop 96 provided at the face 97 of the bottom plate 28, being f.i., attached or integrally shaped onto it.

The front end of the stop 96 is shaped in the form of a nose 98 which can be brought into engagement with nose 94 of the head 92.

In the position as per FIG. 1, the locking device is opened, i.e. the wedge 44 will not extend into the slots 50 and 54 of the bottom plate 28, or, respectively, the anchor plate 56.

In this position of the locking device, the end wall 14 may be pivoted around the joint bolt 16 (FIG. 1) and folded down flat.

If the end wall is now unfolded upright, the bottom plate 28 is pivoted counterclockwise around the center axis of the joint bolt 16, until the nose 98 of the stop 96 will impact upon the nose 94 of the head 92. This impacting of the two noses 98 and 94 occurs before the end wall 14, has reached its upright position. With a further unfolding of the end wall 14 the nose 98 exerts a force onto the nose 94, by which the head 92 is pivoted clockwise around its bearing, which in this case is a bore 88 in the leg 74 of the bottom plate. The two noses 98 and 94 are in engagement at least until the guide pin or its longitudinal center axis have clockwise passed the connection line 68. Since the head 92 is connected via the pin 60 and the strap 58 with the arm 40 of the two-armed lever 36, the latter is pivoting counterclockwise as long as the noses 98 and 94 are in engagement. After, as explained before, the longitudinal center axis of the guide pin 87 has passed the connecting line 68, the compression spring 62 takes over further action upon the two-armed lever 36, i.e. the two-armed lever 36 continues to be pivoted counterclockwise around its pin 34 by the force of this spring, whereby the wedge 44 is brought into the position II in which it can reach through the slots 50 and 54 of the bottom plate 28 and the anchor plate 56, as shown in FIG. 2.

By the unfolding movement of the end wall 14 together with the bottom plate 28 connected to it and the latter's stop 96, the head 92 is positively pushed out and pivoted by the nose 98, whereby the wedge 44 will engage the slots 50 and 54, causing the end wall 14 to be locked with the floor plate 12.

As soon as the two noses 98 and 94 are released from each other by the pivoting movement of the head 92, the nose 98 continues to move freely and without encumbrance into its position 98.

For opening of the locking device, the arm 40 of the lever 36 is pressed down, i.e. the lever 36 is pivoted clockwise around its pin 34. The device then assumes the position marked in FIG. 4 with I. The strap 58 and the head 92 with its nose 94 can now move freely below the stop 96. If now the end wall 14 is folded inward around the joint pin 16, i.e. pivoted clockwise, the stop 96 and its nose 98 will also move in the same direction of rotation. The stop 96 will slide with its lower surface over the upper edge of the nose 94 of the head 92 whereby the latter is somewhat pressed downward. This evasive movement of the head 92 can be supported by having the head 92 resting on the pin 60 by means of a slot 100, (alternatively, such a slot may also be incorporated into the strap 58).

The bearing bore 88 in the leg 74 of the floor plate 12, in which the guide pin 87 is supported, or held respectively, is of a somewhat larger diameter than the guide pin 87, in order to allow its pivoting movement. A disc 90 provided with a bore is located on the leg 74, the guide pin 87 reaching through it and the compression spring 67 resting against it.

It will be understood that each of the elements described above, or two or more together, may also find a useful application in other types of fold-flats differing from the types described above.

While the invention has been illustrated and described as embodied in a fold-flat, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fold-flat for supporting goods to be transported, comprising a floor plate; two end walls, said end walls being arranged to be folded when the fold-flat is transported in empty state or to be mounted in upright position when the fold-flat is loaded; and means for locking said end walls in the upright position, said locking means including at least one wedge, a lever having a first arm and a second arm connected to said first arm, and an axle mounted on said floor plate and extending substantially horizontally and through said lever in the region of connection of said first and second arms thereof, each of said walls being formed with at least one slot, said wedge being pivotable about said first arm and said lever being pivotable about said axle to move said wedge between a closed position in which said wedge is locked within said slot and an open position in which said wedge is out of register with said slot whereby said end walls can be locked in the upright position and braced relative to each other.

2. The fold-flat of claim 1, wherein said first arm is provided with a pivot extending substantially horizontally, said wedge being pivotable about said pivot.

3. The fold-flat of claim 2, wherein said wedge includes a stop operative for limiting the pivoting movement of said wedge about said pivot.

4. The fold-flat of claim 3, wherein said second arm of said lever forms an operating handle.

5. The fold-flat of claim 4, further comprising a spring on said floor plate, said operating handle being biased in a direction to said closed position by said spring.

6. The fold-flat of claim 5, wherein said spring is a compression spring arranged between said operating handle and said floor plate so that, upon the movement of said wedge in a direction of said open position said wedge can be pivoted across an imaginary connecting line extending between the axis of said axle and the point of attachment of said spring at said floor plate whereby said lever can be arrested when said wedge is in its open position.

7. The fold-flat of claim 6, wherein the weight of said wedge is sufficiently large to enable said wedge to move into said closed position.

8. The fold-flat of claim 7, wherein each of said end walls includes a corner post having a center line and said lever has its center line, the center line of said corner post being essentially aligned with the center line of said lever.

9. The fold-flat of claim 8, wherein said floor plate includes an anchor plate rigidly attached thereto, said anchor plate being formed with an opening partially aligned with said slot, said wedge projecting through said opening and resting therein in said closed position.

10. The fold-flat of 8, wherein a stop element is provided on said end wall, said stop element effecting said lever which, upon unfolding said end wall into its upright position, can be pivoted about said pivot in the direction of said closed position.

11. The fold-flat of claim 10, including a guiding pin supporting said compression spring and movably connected to said operating handle, said pin incorporating a nose, said stop element including a projection, said projection cooperating with said nose to effect said lever in the direction of said closed position.

* * * * *